US011271344B2

(12) United States Patent
Furlong

(10) Patent No.: US 11,271,344 B2
(45) Date of Patent: Mar. 8, 2022

(54) STRAIN RELIEF APPARATUS FOR WIRE HARNESS ASSEMBLY

(71) Applicant: Delta Air Lines, Inc., Atlanta, GA (US)

(72) Inventor: Michael Furlong, Sharpsburg, GA (US)

(73) Assignee: Delta Air Lines, Inc., Atlanta, GA (US)

( * ) Notice: Subject to any disclaimer, the term of this patent is extended or adjusted under 35 U.S.C. 154(b) by 0 days.

(21) Appl. No.: 16/789,769

(22) Filed: Feb. 13, 2020

(65) Prior Publication Data

US 2021/0184395 A1 Jun. 17, 2021

Related U.S. Application Data

(60) Provisional application No. 62/947,771, filed on Dec. 13, 2019.

(51) Int. Cl.
*H01R 13/58* (2006.01)
*H01R 13/627* (2006.01)

(52) U.S. Cl.
CPC ..... *H01R 13/5825* (2013.01); *H01R 13/5804* (2013.01); *H01R 13/6271* (2013.01)

(58) Field of Classification Search
CPC ..... H01R 13/5825; H01R 13/5804; H01R 13/5812; H01R 13/582; H01R 13/5829; H01R 13/506
See application file for complete search history.

(56) References Cited

U.S. PATENT DOCUMENTS

| | | | | |
|---|---|---|---|---|
| 5,199,891 | A | 4/1993 | Reed | |
| 5,391,092 | A * | 2/1995 | Sumida | H01R 13/516 439/470 |
| 5,624,273 | A | 4/1997 | Myer | |
| 5,695,358 | A | 12/1997 | Myer et al. | |
| 6,019,638 | A * | 2/2000 | Saka | H01R 13/7197 439/470 |
| 6,815,616 | B1 | 11/2004 | King, Jr. et al. | |
| 6,878,009 | B2 * | 4/2005 | Amemiya | H01R 13/5812 439/467 |
| 8,568,159 | B2 * | 10/2013 | Noda | H01R 13/5812 439/470 |
| 8,845,359 | B2 * | 9/2014 | Taylor | H01R 13/501 439/447 |
| 9,461,400 | B2 * | 10/2016 | Kanda | H01R 13/5829 |
| 9,537,249 | B2 * | 1/2017 | Grudzewski | H01R 13/502 |
| 2008/0090447 | A1 | 4/2008 | Moravy | |

* cited by examiner

*Primary Examiner* — Renee S Luebke
*Assistant Examiner* — Paul D Baillargeon
(74) *Attorney, Agent, or Firm* — Edell, Shapiro & Finnan, LLC

(57) ABSTRACT

A wire connector strain relief apparatus is provided herein. The wire connector strain relief apparatus includes a body having a generally U-shaped cross-section, a first end, and a second end. The first end of the body is configured to receive a wire harness that includes one or more wires to be, or already, connected to an electrical connector. The second end of the body includes one or more structural features configured to engage with one or more structural features of an external surface of the electrical connector to attach to the electrical connector and minimize relative movement between the wire harness and the electrical connector.

20 Claims, 11 Drawing Sheets

STRAIN RELIEF APPARATUS FOR WIRE HARNESS ASSEMBLY

CROSS REFERENCE TO RELATED APPLICATION

This application claims the benefit of U.S. Provisional Application No. 62/947,771, filed Dec. 13, 2019, the entirety of which is incorporated herein by reference.

TECHNICAL FIELD

The present disclosure relates generally to wire harnesses.

BACKGROUND

Wire harnesses can include one or more wires that terminate at an electrical connector. The electrical connector enables the wires to securely connect to a device. The one or more wires generally run some distance between the wire harness and the electrical connector to allow the one or more wires to connect to one or more respective slots or connector points of the electrical connector. Thus, there is some portion of the one or more wires that run outside the wire harness and the electrical connector. Without physical support from the wire harness or electrical connector, that portion of the one or more wires can experience mechanical strain due to tension (e.g., curving/bending). Given enough time, the mechanical strain can cause a number of safety and electrical issues such as degradation of the individual insulators of the one or more wires (e.g., exposed wires), cut/broken wires, etc.

DESCRIPTION OF EXAMPLE EMBODIMENTS

Overview

A wire connector strain relief apparatus is provided. The wire connector strain relief apparatus includes a body having a generally U-shaped cross-section, a first end, and a second end. The first end is configured to receive a wire harness that includes one or more wires to be, or already, connected to an electrical connector. The second end of the body includes one or more structural features configured to engage with one or more structural features of an external surface of the electrical connector to attach to the electrical connector and minimize relative movement between the wire harness and the electrical connector.

EXAMPLE EMBODIMENTS

Figure 1:
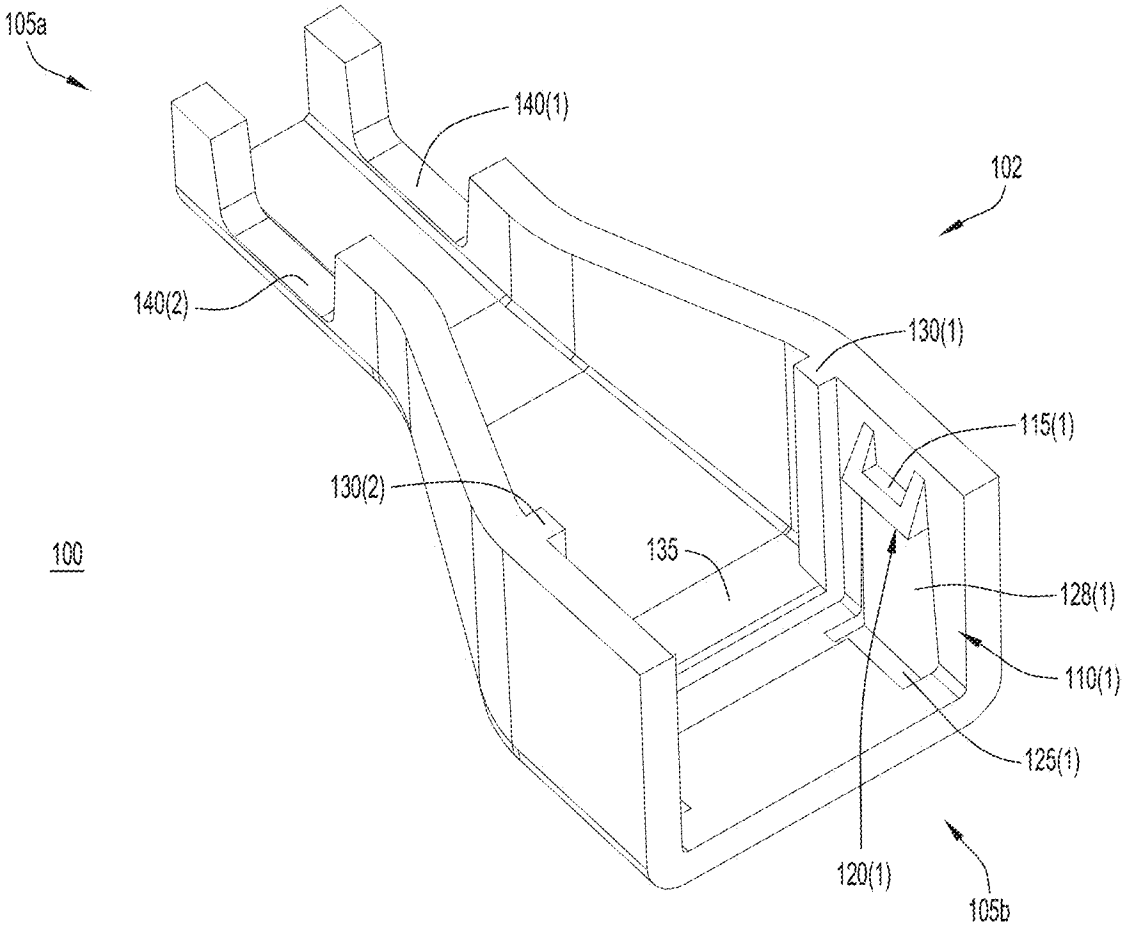
FIG. 1 illustrates a top perspective view of a wire connector strain relief apparatus for a wire harness assembly, according to an example embodiment.

FIGS. 1-4 illustrate respective views of an example wire connector strain relief apparatus 100 for a wire harness assembly. Turning first to FIG. 1, shown is a top perspective view of wire connector strain relief apparatus 100 for a wire harness assembly. Wire connector strain relief apparatus 100 includes a body 102 having a generally U-shaped cross-section. Body 102 has a first end 105*a* configured to receive a wire harness that includes one or more wires connected to an electrical connector. Body 102 also has a second end 105*b* having one or more structural features that are configured to engage with one or more structural features on an external surface of the electrical connector.

The one or more structural features of the second end 105*b* of body 102 may include snap feature 110(1). Snap feature 110(1) includes inclined surface 115(1) and ledge 120(1). Inclined surface 115(1) may protrude from, and be inclined relative to, the inner surface of the side of body 102. Ledge 120(1) may also protrude from the inner surfaces of the side of body 102. Ledge 120(1) may be substantially perpendicular to the sides of body 102. The inclined surface 115(1) and the ledge 120(1) are configured to snap fit to the one or more structural features of an external surface of an electrical connector. As described in more detail below in connection with FIGS. 5-8, there is a surface feature on an electrical connector that slides down the inclined surface 115(1) that then becomes lodged beneath the ledge 120(1), thus snap-fitting into the body 102.

Snap feature 110(1) may further include one or more structural features defining hole 125(1). Hole 125(1) may be a hole in the bottom of body 102, and may be positioned beneath inclined surface 115(1) and ledge 120(1). Depressed portion 128(1) of the inner surface of the sides of body 102 may extend vertically from inclined surface 115(1) and ledge 120(1) to hole 125(1). The body 102 may be configured to engage a surface feature of an electrical connector at the hole 125(1), as described in more detail below in connection with FIGS. 5-8.

The one or more structural features of the second end 105*b* of the body 102 may further include one or more locating features, such as locating ribs 130(1) and 130(2) and/or locating groove 135. Locating ribs 130(1) and 130(2) may protrude from the inner surface of the sides of body 102, and may extend the entirety of the vertical distance along the sides of body 102. Locating groove 135 may be a depression in the inner surface of the bottom of body 102, and may extend the entirety of the horizontal distance along the bottom of body 102. Locating ribs 130(1) and 130(2) and/or locating groove 135 are sized and positioned in the body 102 so as to engage a surface feature of an electrical connector to enable a user to positively locate the electrical connector within the body 102, and in particular, to orient surface features of the electrical connector to engage the snap features 110(1) and 110(2).

The first end 105*a* of the body 102 may include slots or cutaways 140(1) and 140(2) configured to accommodate a tie-wrap or similar securing element. The bottom of slots 140(1) and 140(2) may be substantially parallel to the bottom of body 102, and the sides of slots 140(1) and 140(2) may be substantially parallel to the sides of body 102. Slots 140(1) and 140(2) may allow a tie-wrap or other securing element to secure the wire harness to the body 102.

Figure 2:
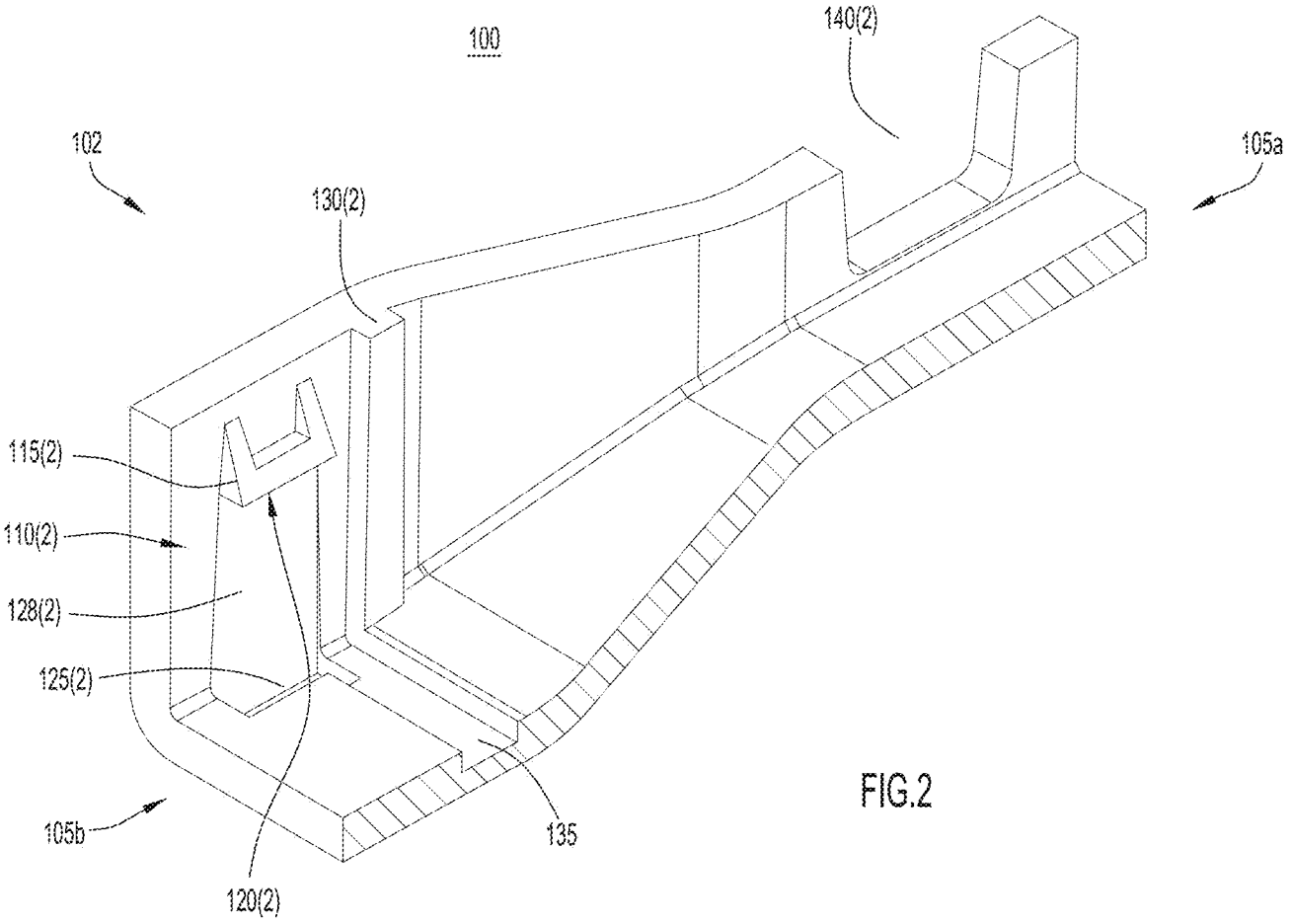
FIG. 2 illustrates a partial perspective cut-away view of the wire connector strain relief apparatus of FIG. 1, according to an example embodiment.

FIG. 2 illustrates a partial perspective cut-away view of the wire connector strain relief apparatus 100. As shown, the one or more structural features of the second end 105*b* of body 102 may further include snap feature 110(2). Snap feature 110(2) includes inclined surface 115(2) and ledge 120(2). Inclined surface 115(2) may protrude from, and be inclined relative to, the inner surface of the side of body 102. Ledge 120(2) may also protrude from the inner surfaces of the sides of body 102. Ledge 120(2) may be substantially perpendicular to the side of body 102. The inclined surface 115(2) and the ledge 120(2) are configured to snap fit to the one or more structural features of an external surface of an electrical connector. As described in more detail below in connection with FIGS. 5-8, there is a surface feature on an electrical connector that slides down the inclined surface 115(2) that then becomes lodged beneath the ledge 120(2), thus snap-fitting into the body 102.

Snap feature 110(2) may further include one or more structural features defining hole 125(2). Hole 125(2) may be a hole in the bottom of body 102, and may be positioned beneath inclined surface 115(2) and ledge 120(2). Depressed portion 128(2) of the inner surface of the sides of body 102 may extend vertically from inclined surface 115(2) and ledge 120(2) to hole 125(2). The body 102 may be configured to engage a surface feature of an electrical connector at the hole 125(2), as described in more detail below in connection with FIGS. 5-8.

Figure 3:
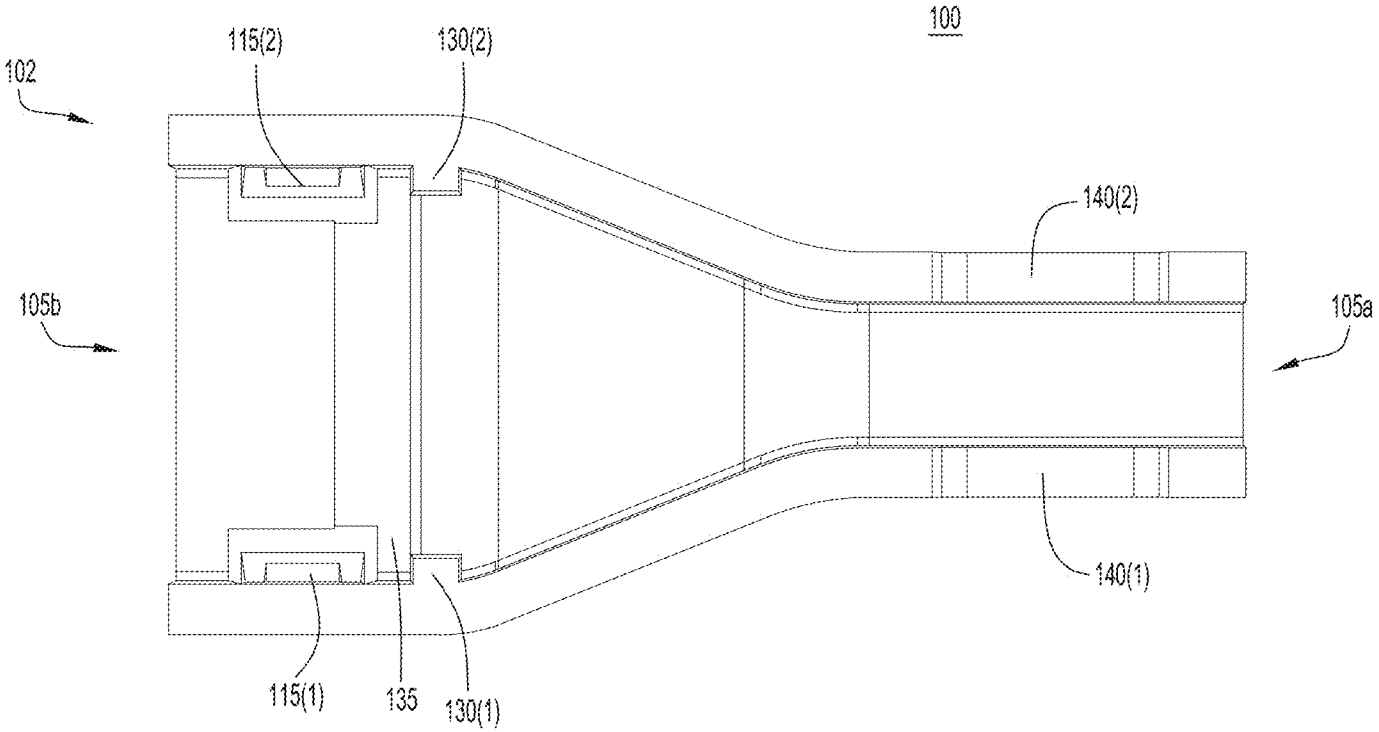
FIG. 3 illustrates a top view of the wire connector strain relief apparatus of FIG. 1, according to an example embodiment.

FIG. 3 illustrates a top view of the wire connector strain relief apparatus 100. In one example, an electrical connector may be aligned with the second end 105*b* and snap-fit into the wire connector strain relief apparatus 100 (e.g., the electrical connector may slide into the top of wire connector strain relief apparatus 100). As shown, the generally U-shaped cross section of body 102 also provides an open design that allows for visual inspection of the wire connector strain relief apparatus 100, electrical connector, wire harness, and/or one or more wires. For example, visual inspection may be made to further ensure that the electrical connector is in the appropriate position (e.g., using locating ribs 130(1) and 130(2)) such that the electrical connector snap-fits to inclined surfaces 115(1) and 115(2). Visual inspection may also be made to monitor the one or more wires for breakages or electrical exposures.

Figure 4:
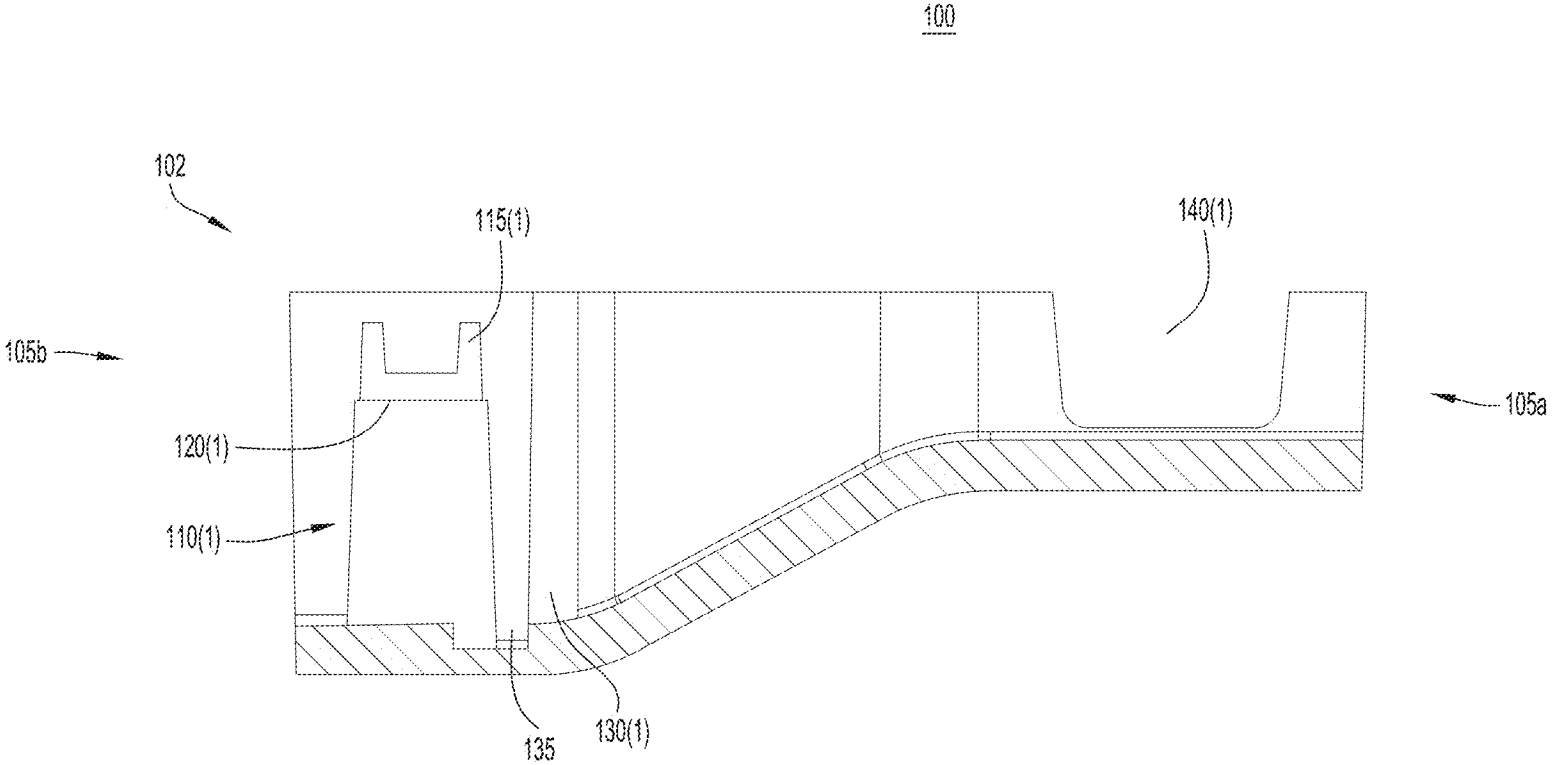
FIG. 4 illustrates a side cut-away view of the wire connector strain relief apparatus of FIG. 1, according to an example embodiment.

FIG. 4 illustrates a side cut-away view of the wire connector strain relief apparatus 100. As shown, the second end 105*b* may be relatively deep to enable the second end 105*b* to accommodate an electrical connector. The first end 105*a* may be relatively shallow to enable the first end 105*a* to accommodate the wire harness and/or one or more wires. The body 102 may be made of any suitable material capable of minimizing relative movement between a wire harness and an electrical connector. For instance, the body 102 may be made of an aircraft-approved material, such as an aircraft-approved plastic (e.g., polycarbonate). In particular, the body 102 may be engineered to comply with Federal Aviation Administration (FAA) regulations, and may be aerospace rated.

Figure 5:
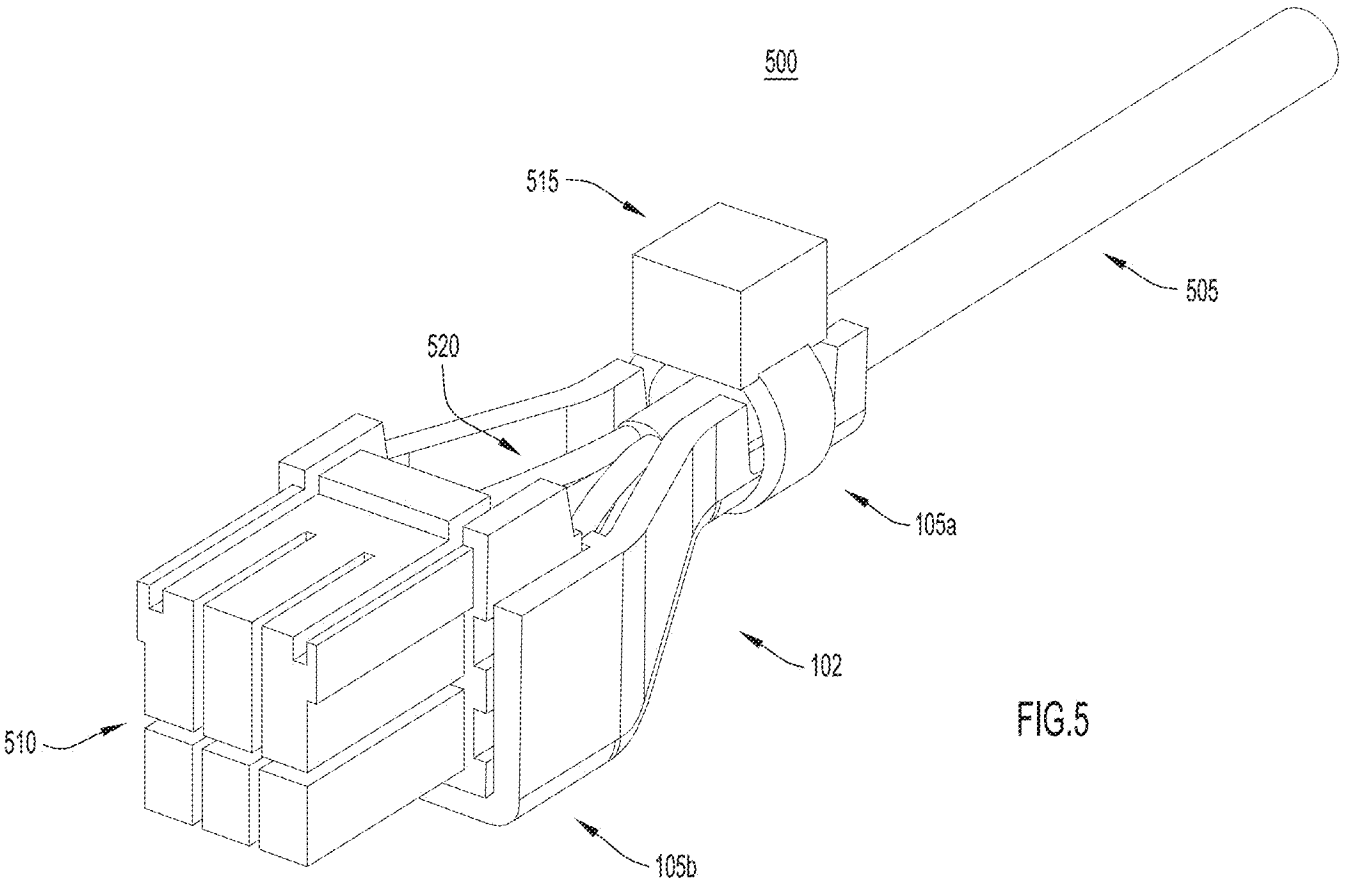
FIG. 5 illustrates a perspective view of a system including a wire connector strain relief apparatus of FIG. 1 attached to a wire harness assembly that is connected to an electrical connector, according to an example embodiment.

FIGS. 5-8 illustrate respective views of an example system 500 including the wire connector strain relief apparatus 100 depicted in FIGS. 1-4. Turning first to FIG. 5, shown is a perspective view of system 500, which includes wire harness 505, electrical connector 510, and a tie-wrap or other similar securing element 515. Wire harness 505 includes one or more wires 520 to be connected, or which have already been connected, to electrical connector 510. The first end 105*a* of body 102 is configured to receive wire harness 505. The one or more structural features of the second end 105*b* of the body 102 are configured to mate with complementary structural features of electrical connector 510.

Figure 6:
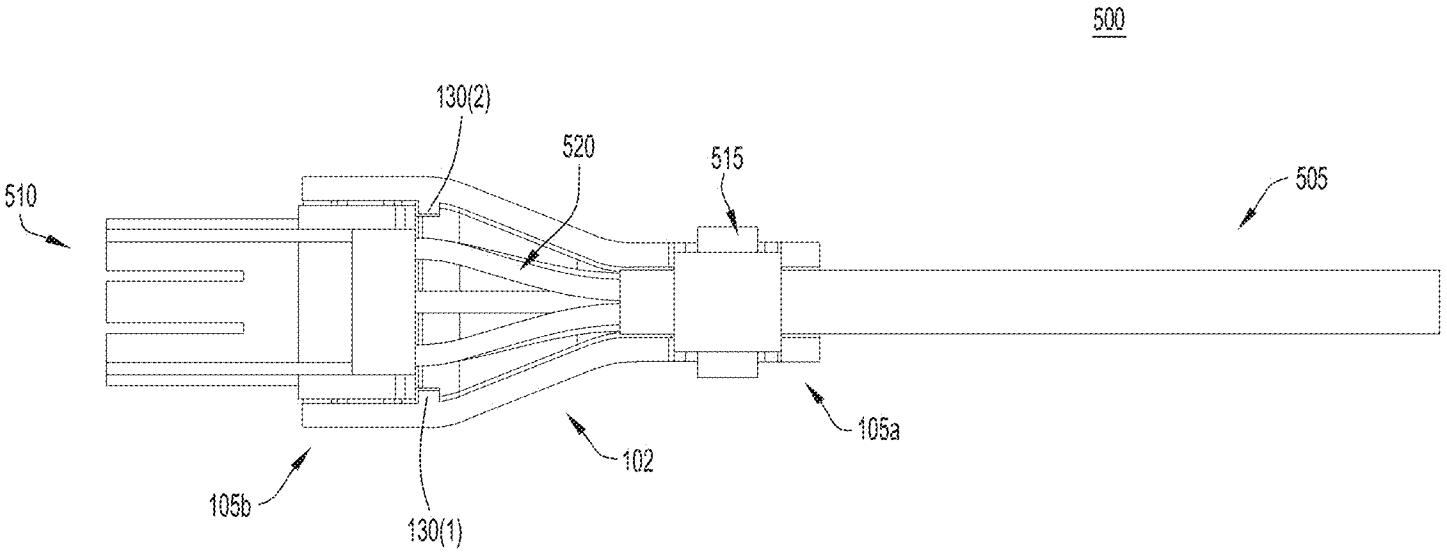
FIG. 6 illustrates a top view of the system shown in FIG. 5, according to an example embodiment.

FIG. 6 illustrates a top view of the system 500. The one or more structural features of the second end 105*b* of the body 102 (e.g., locating ribs 130(1) and 130(2)) are configured to mate with complementary structural features of electrical connector 510. In particular, the one or more structural features of the external surface of electrical connector 510 may include one or more surface features that is/are complementary to locating ribs 130(1) and 130(2). Locating ribs 130(1) and 130(2) may thus help guide electrical connector 510 to the appropriate position such that electrical connector 510 snap fits into the wire connector strain relief apparatus 100. As shown, the generally U-shaped cross section of body 102 also provides an open design that allows for visual inspection of system 500. For example, visual inspection may be made to further ensure that electrical connector 510 is in the appropriate position with respect to locating ribs 130(1) and 130(2). Visual inspection may also be made to monitor the one or more wires 520 for breakages or electrical exposures.

Figure 7:
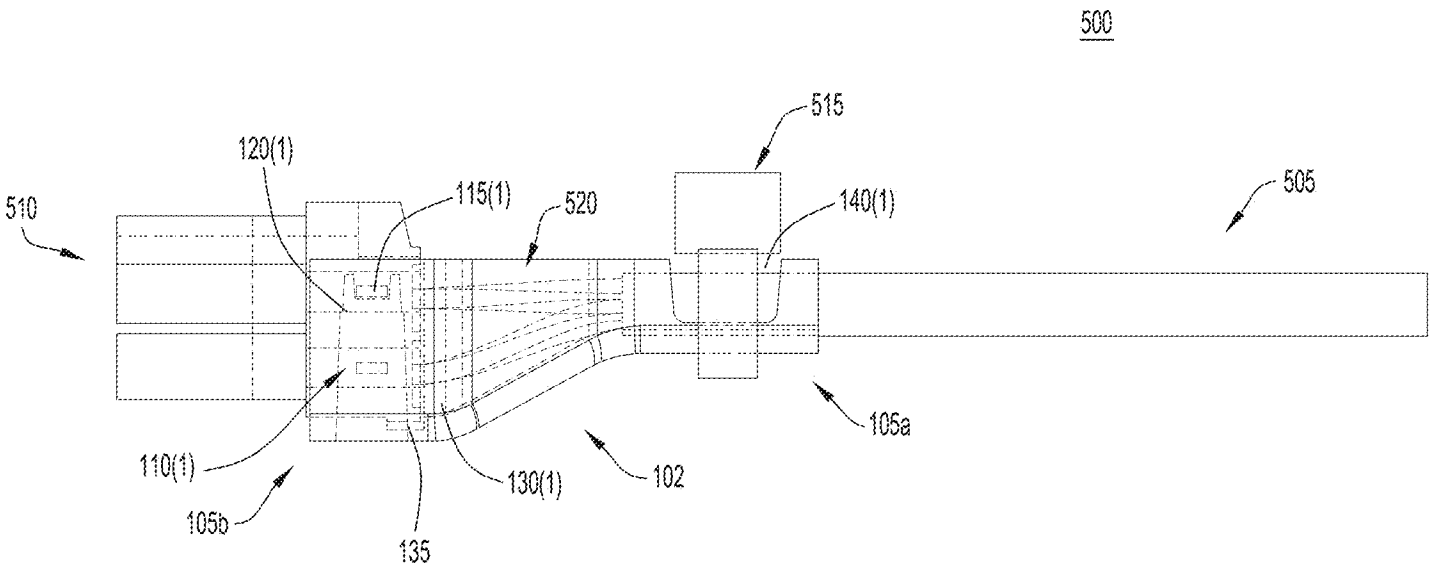
FIG. 7 illustrates a side view of the system shown in FIG. 5, according to an example embodiment.

FIG. 7 illustrates a side view of system 500. The one or more structural features of the second end 105*b* of the body 102 (e.g., snap feature 110(1), locating rib 130(1), locating groove 135, etc.) are configured to mate with complementary structural features of electrical connector 510. In particular, one or more structural features of the external surface of electrical connector 510 may include a surface feature that is complementary to inclined surface 115(1) and/or ledge 120(1). Thus, wire connector strain relief apparatus 100 may provide snap-on strain relief for one or more wires 520. That is, electrical connector 510 may snap into the second end 105*b* of body 102 via snap feature 110(1). This will minimize relative movement between wire harness 505 and electrical connector 510, thereby alleviating mechanical strain on one or more wires 520.

The one or more structural features of the external surface of electrical connector 510 may further include one or more surface features that is/are complementary to locating rib 130(1) and/or locating groove 135. Locating rib 130(1) and/or locating groove 135 may thus help guide electrical connector 510 to the appropriate position such that electrical connector 510 snap fits into snap feature 110(1).

Figure 8:
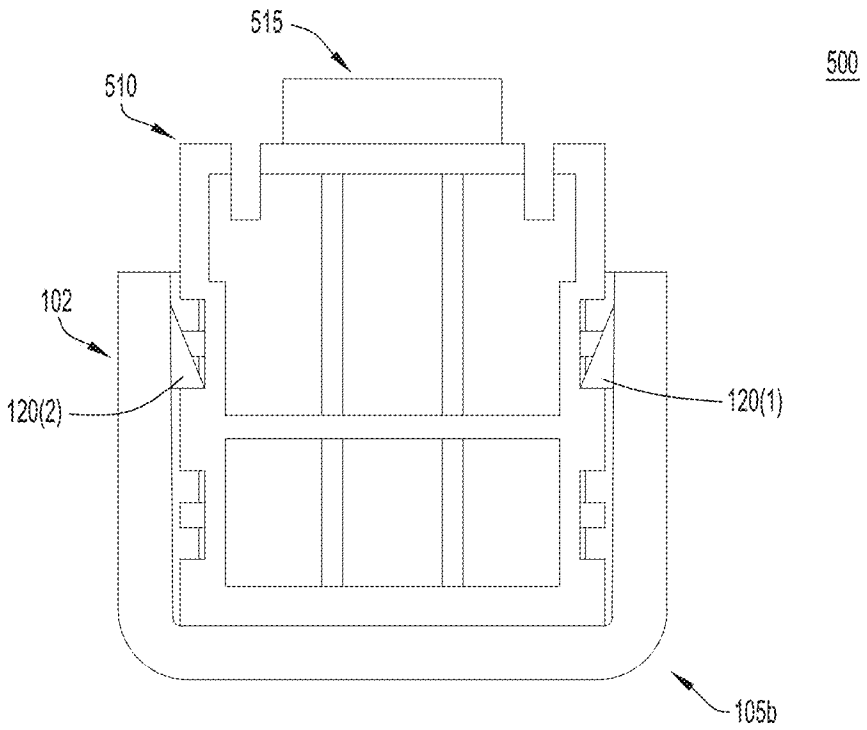
FIG. 8 illustrates a front view of the system shown in FIG. 5, according to an example embodiment.

FIG. 8 illustrates a front view of system 500. As shown, the one or more structural features of the second end 105*b* of the body 102 are configured to mate with complementary structural features of electrical connector 510. In particular, one or more structural features of the external surface of electrical connector 510 may include a surface feature that is complementary to ledges 120(1) and 120(2). That is, electrical connector 510 may snap into the second end 105*b* of body 102 via ledges 120(1) and 120(2).

Body 102 may include a one-piece design capable of installation without using any tools. For example, electrical connector 510 may be inserted into the second end 105*b* of body 102 to secure electrical connector 510 via snap features 110(1) and 110(2). However, it will be appreciated that the particular configuration of the structural features configured on the body of a wire connector strain relief apparatus provided herein may depend upon the particular type/model of corresponding electrical connector. For example, snap features 110(1) and 110(2) may be customized for electrical connector 510. Other electrical connectors may involve other snap feature configurations. Thus, any given electrical connector may utilize the concepts of the uniquely designed strain relief apparatus presented herein.

Figure 9A:
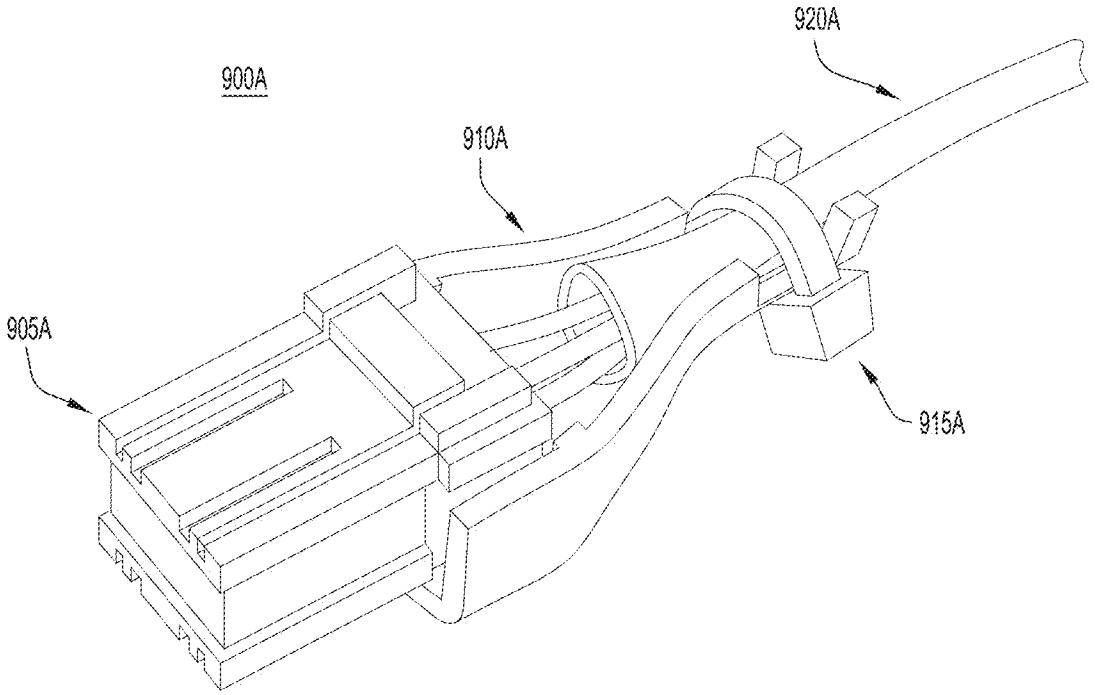
FIGS. 9A and 9B illustrate respective systems including respective wire connector strain relief apparatus versions for different types/models of electrical connectors, according to an example embodiment.
Figure 9B:
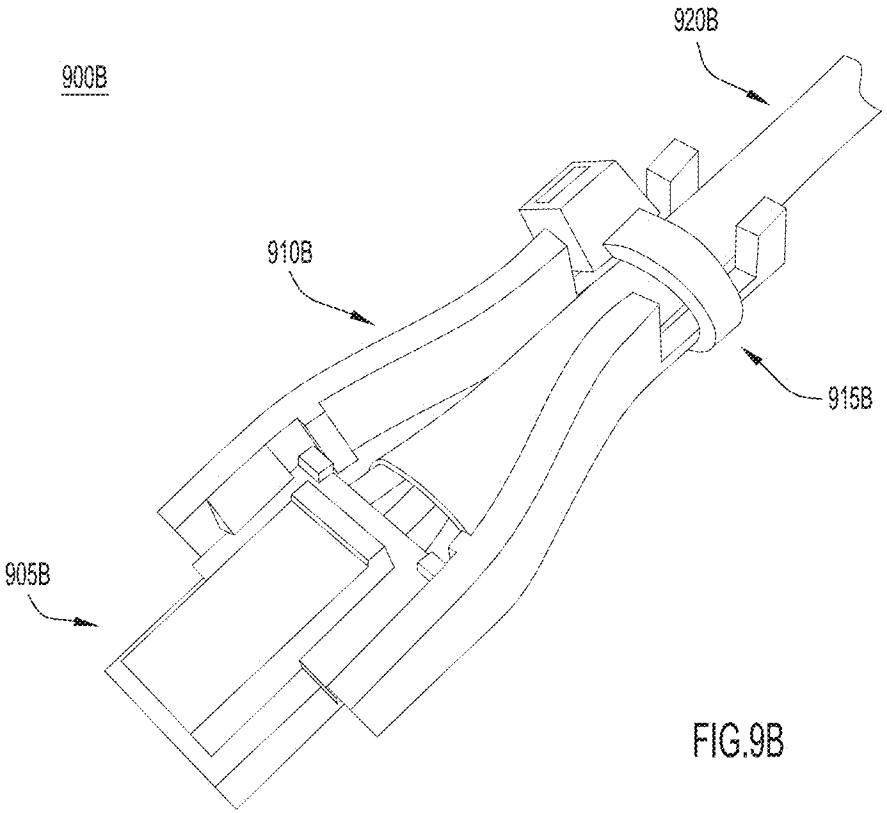

FIGS. 9A and 9B illustrate respective systems 900A and 900B including respective example wire connector strain relief apparatus versions for different types/models of electrical connectors. System 900A includes electrical connector 905A, wire connector strain relief apparatus version 910A, tie-wrap 915A, and wire harness 920A. System 900B includes electrical connector 905B, wire connector strain relief apparatus version 910B, tie-wrap 915B, and wire harness 920B. Electrical connectors 905A and 905B may be different types/models, and therefore wire connector strain relief apparatus versions 910A and 910B may have different snap feature configurations customized for respective electrical connectors 905A and 905B.

Figure 10:
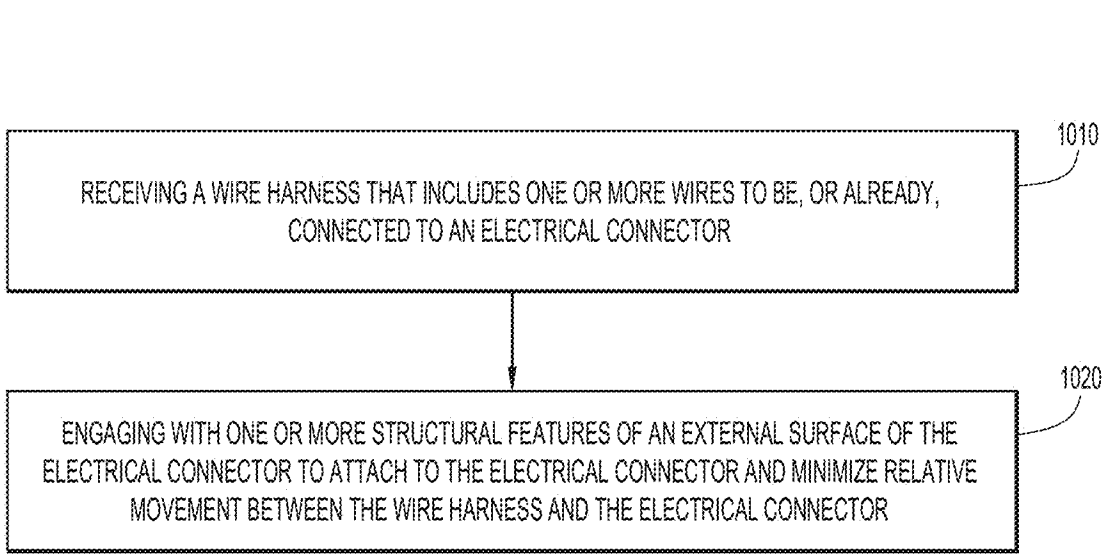
FIG. 10 illustrates a flowchart of a method for providing strain relief to a wire harness assembly, according to an example embodiment.

FIG. 10 illustrates a flowchart of an example method 1000 for providing strain relief to a wire harness assembly. Method 1000 may be performed by wire connector strain relief apparatus that includes a body having a generally U-shaped cross-section, a first end of the body, and a second end of the body (e.g., wire connector strain relief apparatus 100). At 1010, the wire connector strain relief apparatus receives, at the first end of the body, a wire harness that includes one or more wires to be, or already, connected to an electrical connector. At 1020, the wire connector strain relief apparatus engages, by one or more structural features of the second end of the body, with one or more structural features of an external surface of the electrical connector to attach to the electrical connector and minimize relative movement between the wire harness and the electrical connector.

In one form, a wire connector strain relief apparatus is provided. The wire connector strain relief apparatus comprises a body having a generally U-shaped cross-section, a first end, and a second end, wherein: the first end of the body is configured to receive a wire harness that includes one or more wires to be, or already, connected to an electrical connector; and the second end of the body includes one or more structural features configured to engage with one or more structural features of an external surface of the electrical connector to attach to the electrical connector and minimize relative movement between the wire harness and the electrical connector.

In one example of the wire connector strain relief apparatus, the one or more structural features of the second end of the body include an inclined surface and a ledge, and the one or more structural features of the external surface of the electrical connector include a surface feature of the electrical connector that slides over the inclined surface and becomes lodged beneath the ledge, and wherein the inclined surface and the ledge are configured to snap fit to the one or more structural features of the external surface of the electrical connector.

In one example of the wire connector strain relief apparatus, the one or more structural features of the second end of the body define a hole that is complementary to, and configured to mate with, a surface feature of the electrical connector.

In one example of the wire connector strain relief apparatus, the one or more structural features of the second end of the body include a locating rib that is sized and positioned in the second end of the body so as to engage with a surface feature of the electrical connector.

In one example of the wire connector strain relief apparatus, the one or more structural features of the second end of the body include a locating groove that is sized and positioned in the second end of the body so as to engage with a surface feature of the electrical connector.

In one example of the wire connector strain relief apparatus, the first end of the body includes a slot configured to accommodate a securing element to secure to the wire harness.

In one example of the wire connector strain relief apparatus, the body is made of an aircraft-approved material.

In another form, a wire connector strain relief system is provided. The wire connector strain relief system comprises: an electrical connector; a wire harness that includes one or more wires to be, or already, connected to the electrical connector; and a wire connector strain relief apparatus including a body having a generally U-shaped cross-section, a first end, and a second end, wherein the first end of the body is configured to receive the wire harness, and wherein the second end of the body includes one or more structural features configured to engage with one or more structural features of an external surface of the electrical connector to attach to the electrical connector and minimize relative movement between the wire harness and the electrical connector.

In one example of the wire connector strain relief system, the one or more structural features of the second end of the body include an inclined surface and a ledge, and the one or more structural features of the external surface of the electrical connector include a surface feature of the electrical connector that slides over the inclined surface and becomes lodged beneath the ledge, and wherein the inclined surface and the ledge are configured to snap fit to the one or more structural features of the external surface of the electrical connector.

In one example of the wire connector strain relief system, the one or more structural features of the second end of the body define a hole that is complementary to, and configured to mate with, a surface feature of the electrical connector.

In one example of the wire connector strain relief system, the one or more structural features of the second end of the body include a locating rib that is sized and positioned in the second end of the body so as to engage with a surface feature of the electrical connector.

In one example of the wire connector strain relief system, the one or more structural features of the second end of the body include a locating groove that is sized and positioned in the second end of the body so as to engage with a surface feature of the electrical connector.

In one example of the wire connector strain relief system, the first end of the body includes a slot configured to accommodate a securing element to secure to the wire harness.

In one example of the wire connector strain relief system, the body is made of an aircraft-approved material.

In another form, a method for wire connector strain relief is provided. The method for wire connector strain relief comprises: receiving, at a first end of a body having a generally U-shaped cross-section, a wire harness that includes one or more wires to be, or already, connected to an electrical connector; and engaging, by one or more structural features of a second end of the body, with one or more structural features of an external surface of the electrical connector to attach to the electrical connector and minimize relative movement between the wire harness and the electrical connector.

In one example of the method for wire connector strain relief, engaging includes: snap fitting an inclined surface and a ledge of the second end of the body to a surface feature of the electrical connector that slides over the inclined surface and becomes lodged beneath the ledge of the electrical connector.

In one example of the method for wire connector strain relief, engaging includes: mating, to a surface feature of the electrical connector, a hole of the second end of the body that is complementary to the surface feature of the electrical connector.

In one example of the method for wire connector strain relief, engaging includes: engaging a locating rib of the second end of the body with a surface feature of the electrical connector.

In one example of the method for wire connector strain relief, engaging includes: engaging a locating groove of the second end of the body with a surface feature of the electrical connector.

In one example of the method for wire connector strain relief, receiving the wire harness includes: using a securing element, securing the wire harness to a slot of the first end of the body.

The above description is intended by way of example only. Although the techniques are illustrated and described herein as embodied in one or more specific examples, it is nevertheless not intended to be limited to the details shown, since various modifications and structural changes may be made within the scope and range of equivalents of the claims.

What is claimed is:

1. A wire connector strain relief apparatus comprising:

a body having a generally U-shaped cross-section, a first end, and a second end, wherein:

the first end of the body is configured to receive a wire harness that includes one or more wires to be, or already, connected to an electrical connector; and the second end of the body includes one or more structural features configured to engage with one or more structural features of an external surface of the electrical connector to attach to the electrical connector and minimize relative movement between the wire harness and the electrical connector, wherein the one or more structural features of the second end of the body include a locating groove that extends along a substantially horizontal bottom of the body from a first substantially vertical side of the body to a second substantially vertical side of the body, and wherein the one or more structural features of the second end of the body further include a first depressed portion of an inner surface of the first substantially vertical side of the body, wherein the first depressed portion defines a first hole on the substantially horizontal bottom of the body that is complementary to, and configured to mate with, a first surface feature of the electrical connector.

2. The wire connector strain relief apparatus of claim 1, wherein the one or more structural features of the second end of the body further include an inclined surface and a ledge, and the one or more structural features of the external surface of the electrical connector include a surface feature of the electrical connector that slides over the inclined surface and becomes lodged beneath the ledge, and wherein the inclined surface and the ledge are configured to snap fit to the one or more structural features of the external surface of the electrical connector.

3. The wire connector strain relief apparatus of claim 1, wherein the one or more structural features of the second end of the body further include a locating rib that is sized and positioned in the second end of the body so as to engage with a surface feature of the electrical connector.

4. The wire connector strain relief apparatus of claim 1, wherein the first end of the body includes a slot configured to accommodate a securing element to secure to the wire harness.

5. The wire connector strain relief apparatus of claim 1, wherein the body is made of an aircraft-approved material.

6. The wire connector strain relief apparatus of claim 1, wherein the one or more structural features of the second end of the body further include a second depressed portion of an inner surface of a second substantially vertical side of the body.

7. The wire connector strain relief apparatus of claim 6, wherein the second depressed portion defines a second hole on the substantially horizontal bottom of the body that is complementary to, and configured to mate with, a second surface feature of the electrical connector.

8. A wire connector strain relief system comprising:

an electrical connector;

a wire harness that includes one or more wires to be, or already, connected to the electrical connector; and a wire connector strain relief apparatus including a body having a generally U-shaped cross-section, a first end, and a second end, wherein the first end of the body is configured to receive the wire harness, and wherein the second end of the body includes one or more structural features configured to engage with one or more structural features of an external surface of the electrical connector to attach to the electrical connector and minimize relative movement between the wire harness and the electrical connector, wherein the one or more structural features of the second end of the body include a locating groove that extends along a substantially horizontal bottom of the body from a first substantially vertical side of the body to a second substantially vertical side of the body, and wherein the one or more structural features of the second end of the body further include a first depressed portion of an inner surface of the first substantially vertical side of the body, wherein the first depressed portion defines a first hole on the substantially horizontal bottom of the body that is complementary to, and configured to mate with, a first surface feature of the electrical connector.

9. The wire connector strain relief system of claim 8, wherein the one or more structural features of the second end of the body further include an inclined surface and a ledge, and the one or more structural features of the external surface of the electrical connector include a surface feature of the electrical connector that slides over the inclined surface and becomes lodged beneath the ledge, and wherein the inclined surface and the ledge are configured to snap fit to the one or more structural features of the external surface of the electrical connector.

10. The wire connector strain relief system of claim 8, wherein the one or more structural features of the second end of the body further include a locating rib that is sized and positioned in the second end of the body so as to engage with a surface feature of the electrical connector.

11. The wire connector strain relief system of claim 8, wherein the first end of the body includes a slot configured to accommodate a securing element to secure to the wire harness.

12. The wire connector strain relief system of claim 8, wherein the body is made of an aircraft-approved material.

13. The wire connector strain relief system of claim 8, wherein the one or more structural features of the second end of the body further include a second depressed portion of an inner surface of the second substantially vertical side of the body.

14. The wire connector strain relief system of claim 13, wherein the second depressed portion defines a second hole on the substantially horizontal bottom of the body that is complementary to, and configured to mate with, a second surface feature of the electrical connector.

15. A method for wire connector strain relief comprising:

receiving, at a first end of a body having a generally U-shaped cross-section, a wire harness that includes one or more wires to be, or already, connected to an electrical connector; and engaging, by one or more structural features of a second end of the body, with one or more structural features of an external surface of the electrical connector to attach to the electrical connector and minimize relative movement between the wire harness and the electrical connector, wherein the one or more structural features of the second end of the body include a locating groove that extends along a substantially horizontal bottom of the body from a first substantially vertical side of the body to a second substantially vertical side of the body, wherein the engaging includes mating, to a first surface feature of the electrical connector, a first hole on the substantially horizontal bottom of the body that is complementary to a first surface feature of the electrical connector, wherein the first hole is defined by a first depressed portion of an inner surface of the first substantially vertical side of the body.

16. The method for wire connector strain relief of claim 15, wherein engaging includes:

snap fitting an inclined surface and a ledge of the second end of the body to a surface feature of the electrical connector that slides over the inclined surface and becomes lodged beneath the ledge of the electrical connector.

17. The method for wire connector strain relief of claim 15, wherein engaging includes:

engaging a locating rib of the second end of the body with a surface feature of the electrical connector.

18. The method for wire connector strain relief of claim 15, wherein receiving the wire harness includes:

using a securing element, securing the wire harness to a slot of the first end of the body.

19. The method for wire connector strain relief of claim 15, wherein engaging further includes:

mating, to a second surface feature of the electrical connector, a second hole on the substantially horizontal bottom of the body that is complementary to a second surface feature of the electrical connector.

20. The method for wire connector strain relief of claim 19, wherein the second hole is defined by a second depressed portion of an inner surface of the second substantially vertical side of the body.

* * * * *